United States Patent [19]

Smrt

[11] 4,099,482

[45] Jul. 11, 1978

[54] MARKING APPARATUS WITH MEASURING DEVICE

[76] Inventor: Thomas J. Smrt, 31W 300 W. Bartlett Rd., Bartlett, Ill. 60103

[21] Appl. No.: 795,712

[22] Filed: May 11, 1977

[51] Int. Cl.[2] ..... B05C 17/00

[52] U.S. Cl. ..... 118/9; 118/305; 222/174

[58] Field of Search ..... 118/305, 9; 222/174; 401/193; 111/99; 33/27 B, 27 C; 248/96, 188.6

[56] References Cited

U.S. PATENT DOCUMENTS

| | | | |
|---|---|---|---|
| 1,743,024 | 1/1930 | Clark | 33/27 B X |
| 2,044,871 | 6/1936 | Beasley | 111/99 |
| 2,214,579 | 9/1940 | Delin | 248/96 |
| 3,485,206 | 12/1969 | Smrt | 118/305 |

FOREIGN PATENT DOCUMENTS

| | | | |
|---|---|---|---|
| 106,694 | 12/1899 | Fed. Rep. of Germany | 111/99 |

*Primary Examiner*—John P. McIntosh

[57] ABSTRACT

A marking apparatus is equipped with a measuring device so that the marking apparatus can make a series of equally spaced marks. The marking apparatus includes an elongated can holder which is adapted to hold an aerosol can of marking material and a trigger for opening the valve of the can to spray the marking material on a surface. The measuring device comprises an elongated rod which is provided with a longitudinally extending slot, and the rod is pivotally and slidably connected to the can holder by a pin or bolt which extends through the slot and a wing nut which is threadedly engaged with the pin. The rod is pivotable between a storage position in which it extends alongside the can holder and a measuring position in which it extends angularly away from the can holder toward the surface. The rod can be releasably locked in either position by tightening the wing nut, and the distance between the end of the rod and the wing nut can be varied by sliding the slotted rod relative to the wing nut. A series of equally spaced marks can be made by placing the end of the rod over the previous mark to space the can holder and spray can a constant distance from the mark.

1 Claim, 4 Drawing Figures

MARKING APPARATUS WITH MEASURING DEVICE

BACKGROUND AND SUMMARY

This invention relates to a marking apparatus, and, more particularly, to a marking apparatus which is equipped with a measuring device so that the marking apparatus can make a series of equally spaced marks.

U.S. Pat. No. 3,485,206 describes a marking apparatus which is adapted for use with an aerosol spray can filled with marking material such as paint, dye, or the like. The aerosol spray can is not equipped with a tube, and the can sprays in the direction in which the valve is pointed. The marking apparatus enables the operator to make marks such as stripes, circles, solid discs, etc. on the ground or other surface while walking normally without stooping or bending.

Such a marking apparatus is often used to make a series of spaced marks, e.g., solid discs or spots on a surface. If the marks are to be equally spaced, the distance between adjacent marks should be measured to ensure accurate spacing. However, if the distance between marks must be individually measured by a tape measure, yard stick, etc., the marking process becomes tedious and time consuming, and much of the advantage of using a marking apparatus which permits a person to mark a surface while walking over the surface is lost.

The invention enables a person to use a marking apparatus to make a series of equally spaced marks while walking over the surface and eliminates the need for a separate measuring operation between each marking operation. The marking apparatus is provided with an elongated rod which is pivotally and slidably connected to the marking apparatus, and locking means can releasably lock the rod in a position in which one end of the rod is spaced a desired distance from the aerosol can. When the end of the rod touches a mark, the aerosol can will make the next mark at a distance from the first mark which is determined by the rod. The process is repeated for succeeding marks, and each pair of adjacent marks will be spaced a constant distance apart by the rod without any measuring operation other than placing the end of the rod over a mark before making the next mark. When the marking apparatus is to be stored or when it is to be used for other marking operations, the rod can be pivoted to a storage position alongside the marking apparatus and releasably locked in place. A clip can be mounted on the rod for engaging the mounting apparatus and holding the rod against the marking apparatus.

DESCRIPTION OF THE DRAWING

The invention will be explained in conjunction with an illustrative embodiment shown in the accompanying drawing, in which.

DESCRIPTION OF SPECIFIC EMBODIMENT

Figures 1, 2, 3, 4:
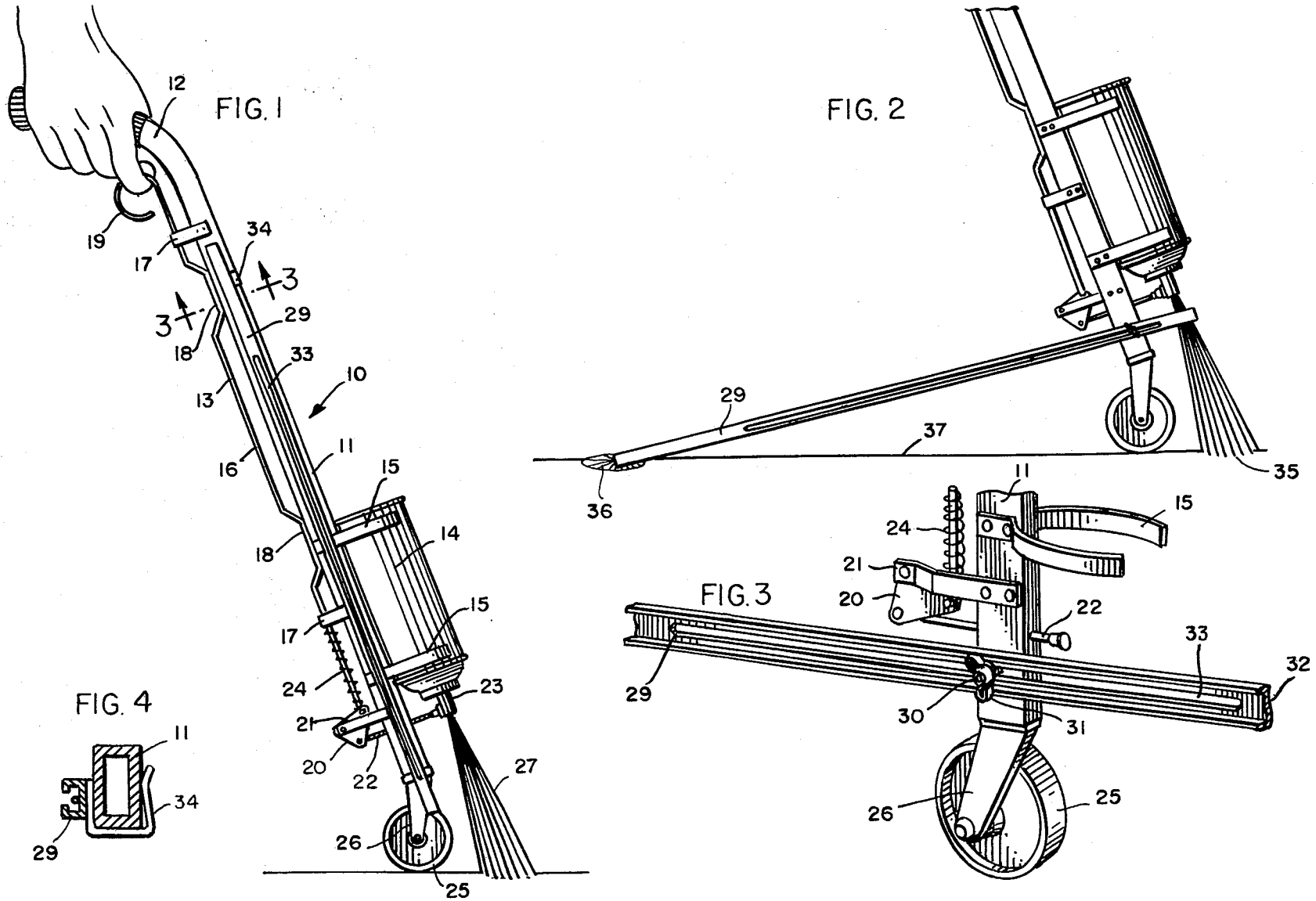
- FIG. 1 is a side elevational view of a marking apparatus equipped with a measuring device in accordance with the invention.
FIG. 2 is a fragmentary elevational view showing the measuring rod in position to space the marking apparatus from the previous mark.
FIG. 3 is an enlarged fragmentary perspective view showing the details of the connection between the measuring rod and the marking apparatus.
FIG. 4 is a sectional view taken along the line 3—3 of FIG. 1.

Referring first to FIG. 1, the numeral 10 designates generally a marking apparatus similar to the marking apparatus described in U.S. Pat. No. 3,485,206. The marking apparatus includes an elongated can-holding rod 11 which terminates in a curved handle portion 12, and a trigger or valve-actuating means 13 which operates the valve of an aerosol spray can 14 mounted on the rod 11. The spray can is releasably connected to the rod by a pair of mounting brackets 15, each of which includes a pair of generally C-shaped arms (FIG. 3) which are formed of resilient spring metal.

The trigger 13 includes an elongated rigid wire or rod 16 which is slidably mounted adjacent the can-holding rod 11 by a pair of support brackets 17 through which the wire extends. The wire is provided with a pair of offset portions 18 which rigidify the wire and which abut the can-holding rod to prevent the wire from moving toward the can-holding rod. The upper end of the wire terminates in a finger-gripping loop 19, and the lower end of the wire is connected to a bell crank 20 which is pivotally mounted on bracket 21. A push rod 22 is also connected to the bell crank and extends through the can-holding rod to engage the spraying nozzle or actuator 23 of the aerosol can. The valve of the aerosol can is of the type which is opened when the spraying nozzle is pushed sideways or transversely relative to the can axis, and when the trigger is pulled upwardly by the operator's finger the bell crank pushes the push rod 22 against the spraying nozzle to move the nozzle and open the valve. A coil spring 24 is ensleeved on the wire 16 between the bell crank and the lower support bracket 17 and resiliently biases the bell crank toward a position in which the push rod does not open the valve.

A wheel 25 is connected to the lower end of the can-holding rod 11 by a wheel mounting bracket 26. The rod 11 is a hollow tube with a rectangular cross section (FIG. 4), and the wheel bracket is frictionally retained in the open lower end of the rod. The wheel is offset from the axis of the rod 11 by the bracket so that it will not roll over material that has been sprayed from the aerosol can.

The mounting apparatus is shown in an appropriate operating position in FIG. 1. The operator holds the handle 12 with one hand and rolls the marking apparatus over the surface to be marked by pushing the handle forwardly. The forward movement of the marking apparatus is facilitated if the can-holding rod 11 is held at a slight angle with respect to the vertical, and the selection of this angle is suggested by the wheel mounting bracket 26, which extends angularly with respect to the axis of the rod 11. When the wheel bracket extends vertically, the rod 11 will be inclined at the appropriate angle away from the direction of movement.

When a mark is to be made, the operator merely pulls the trigger with one finger to open the valve of the aerosol can and spray marking material 27 on the surface. If a stripe is being marked, then the marking apparatus can be rolled continuously over the surface while the can valve is held open. If a series of spots or solid discs is to be marked, it may be desirable to stop forward motion of the marking apparatus so that each mark can be accurately positioned.

An elongated measuring rod 29 is pivotally connected to the can-holding rod 11 by a bolt or pin 30 (FIG. 3) and a wing nut 31 which is threadedly engaged with the pin. The rod is generally channel-shaped in cross section (FIG. 4), and the central or web portion 32 of the rod is provided with an elongated slot 33 through which the pin extends.

The measuring rod is shown in its storage position in FIG. 1 in which the measuring rod extends along side the can-holding rod 11. The upper end of the measuring rod carries a generally C-shaped spring clip 34 (FIG. 4) which fits over the can-holding rod to hold the upper end of the measuring rod against the can-holding rod and to ensure that the measuring rod does not inadvertently pivot downwardly. The measuring rod is also maintained in the storage position by the wing nut, which is tightened on the pin to clamp the measuring rod against the can-holding rod.

When it is desired to make a series of equally spaced marks, the first mark is made as illustrated in FIG. 1. The measuring rod can be in the storage position as illustrated when the first mark is made. The second mark is made by measuring the desired distance from the first mark with a tape measure, yard stick, or the like so that the first two marks are accurately spaced. The second mark is then sprayed in the same manner as the first.

The measuring rod is then pivoted downwardly by loosening the wing nut and moving the measuring rod forwardly sufficiently to disengage the holding clip 34, and the measuring rod is slid relative to the wing nut until the end of the rod touches the center of the first mark. The wing nut is then tightened to lock the measuring rod in place.

The marking apparatus can now make any number of additional marks which will all be spaced apart the same distance as the spacing between the first and second marks merely by moving the marking apparatus forwardly from the second mark until the end of the measuring rod touches the center of the second mark. The third mark is then sprayed, and the process can be repeated for the fourth and succeeding marks. FIG. 2 illustrates the marking apparatus making the third mark 35 a measured distance away from the second mark 36. A guide string 37 is stretched along the surface to ensure that the marks will be made in a straight line.

From the foregoing it will be appreciated that once the desired spacing is established between the first and second marks, the remaining marks can be measured and sprayed merely by moving the marking apparatus forwardly until the rear end of the measuring rod touches the middle of the previous mark. A separate measuring operation for each mark is not necessary, and the marks can be measured and made without bending or stooping.

Once the measuring rod is locked in place, the angular relationship between the can-holding rod and the surface is fixed by the wheel and the end of the rod, both of which are supported by the surface. Accordingly, the can-holding rod will always be inclined in the same spraying direction.

While in the foregoing specification a detailed description of a specific embodiment of the invention was set forth for the purpose of illustration, it is to be understood that many of the details herein given may be varied considerably by those skilled in the art without departing from the spirit and scope of the invention.

I claim:

1. In combination with a marking apparatus for making marks, a measuring device for measuring the distance between adjacent marks, the marking apparatus including an elongated can holder having an upper end and a lower end, means on the can holder for supporting a valve-equipped aerosol can containing marking material, the axis of the can being parallel with the longitudinal dimension of the can holder, valve-opening means on the can holder for opening the valve of the aerosol can and spraying the marking material in a direction parallel with the longitudinal dimension of the can holder, a wheel-mounting bracket attached to the lower end of the can holder and extending angularly therefrom away from the aerosol can to form an included angle of less than 180° with the can holder, and a wheel rotatably mounted on the wheel-mounting bracket for permitting the marking apparatus to be rolled over the surface to be marked, whereby when the wheel-mounting bracket extends substantially perpendicular to said surface the marking material will be sprayed at an acute angle to said surface, the measuring device comprising an elongated rod having first and second ends and a longitudinally extending slot extending from adjacent the first end of the rod toward the second end, the rod being pivotally and slidably connected to the can holder by a pin adjacent the lower end of the can holder and extending through the slot in the rod, a nut threadedly engaged with the pin whereby the rod and the can holder can be clamped together as the nut is tightened on the pin, the rod being pivotable when the nut is loosened on the pin between a storage position in which the rod extends alongside the can holder and a measuring position in which the second end of the rod extends away from the can holder and is engageable with the surface to be marked, the rod being releasably clamped in the measuring position by said nut whereby a series of equally spaced marks can be sprayed and the angle at which the marking material will be sprayed for each mark can be maintained constant by contacting said second end of the rod with a mark before the next mark is sprayed.

* * * * *